US005199486A

United States Patent [19]

Balmer et al.

[11] Patent Number: 5,199,486

[45] Date of Patent: Apr. 6, 1993

[54] COATED HEAT EXCHANGER FOR HUMIDIFIER

[75] Inventors: Rick D. Balmer, Minnetonka; Peter J. Loniello, Richfield; Kirk A. Nelson, Minneapolis, all of Minn.

[73] Assignee: Dri-Steem Humidifier Company, Eden Prairie, Minn.

[21] Appl. No.: 826,455

[22] Filed: Jan. 27, 1992

Related U.S. Application Data

[63] Continuation-in-part of Ser. No. 604,347, Oct. 25, 1990, abandoned, which is a continuation of Ser. No. 195,275, May 18, 1988, abandoned.

[51] Int. Cl.[5] ..... F02M 23/14; F02M 31/00; F28F 13/18; F28F 19/02

[52] U.S. Cl. ..... 165/47; 165/110; 165/174; 165/133; 165/13; 165/132; 122/32; 122/504; 261/153; 261/DIG. 15; 126/113; 237/78 R

[58] Field of Search ..... 165/174, 110, 95, 133, 165/132, 13, 47; 219/275; 122/32, 504; 261/DIG. 15, 153; 126/113; 237/78 R

[56] References Cited

U.S. PATENT DOCUMENTS

| | | | |
|---|---|---|---|
| 540,808 | 6/1895 | Baird | 122/32 |
| 673,767 | 5/1901 | Eycleshymer | 165/174 |
| 1,425,273 | 8/1922 | Pabodie | 122/32 |
| 1,617,081 | 2/1927 | Price | 122/32 |
| 1,802,930 | 4/1931 | Seelert | 165/110 |
| 1,839,234 | 1/1932 | Lehn | 261/153 |
| 1,962,180 | 6/1934 | Dwyer | 165/110 |
| 2,042,087 | 5/1936 | Best | 261/153 |
| 2,061,344 | 11/1936 | Bingham | 261/153 |
| 2,097,602 | 11/1937 | Rohlin | 165/174 |
| 2,102,090 | 12/1937 | Persons | 261/153 |
| 2,104,804 | 1/1938 | Hill | 261/153 |
| 2,143,628 | 1/1939 | Lea | 261/153 |
| 2,263,074 | 11/1941 | Dunham et al. | 165/174 |
| 2,703,228 | 3/1955 | Fleisher | 261/153 |
| 2,892,621 | 6/1959 | Armstrong | 261/153 |
| 3,196,943 | 7/1965 | Haerter | 165/174 |
| 3,556,199 | 1/1971 | DeGroote | 165/132 |
| 3,873,806 | 3/1975 | Schossow | 219/275 |
| 4,116,016 | 9/1978 | Roop et al. | 122/DIG. 13 |
| 4,125,152 | 11/1978 | Kestner et al. | 165/133 |
| 4,139,762 | 2/1979 | Pohrer et al. | 126/113 |
| 4,239,956 | 12/1980 | Morton | 126/113 |
| 4,465,088 | 8/1984 | Vosper | 122/504 |

FOREIGN PATENT DOCUMENTS

| | | | |
|---|---|---|---|
| 433343 | 8/1935 | United Kingdom | 165/174 |

OTHER PUBLICATIONS

"Dri Steem Model STS" Publication of Dristeem Humidifier Co. (1987) Hopkins, Minn. 55343.

"Armstrong Humidifier Book" publication of Armstrong Machine Works Three Rivers, Mich. (Cat. No. 502 20M) 1964.

Powell, Sheppard T., Water Conditioning for Industry, McGraw Hill Book Co. Inc., 1954 p. 200.

Goeller, "Electrical Probe Level Indicator Comes of Age" Combustion/Jun. 1983 pp. 35-38.

Geiringer, High Temperature Water Heating, John Wiley & Sons, New York 1963 pp. 251-256.

*Primary Examiner*—John K. Ford

*Attorney, Agent, or Firm*—Woodcock Washburn Kurtz Mackiewicz & Norris

[57] ABSTRACT

A heat exchange humidifier for generation of steam-to-steam or fluid-to-steam humidity may include at least one steam tube in a heat exchanger array which may be coated with a non-stick surface such as tetrafluoroethylene (TEFLON ®) coating or the like, to prevent the build-up of minerals. The steam tubes in the heat exchanger array are in a substantially layered configuration, each layer being offset and below the preceding upper layer, or in helical configuration. This organization of the tubes in the heat exchanger array maximizes convection currents in a fluid surrounding the steam tubes to minimize dead water films and maximize heat transfer from the steam or fluid inside of the tubes to the surrounding water, resulting in an overall increase in boil-off capacity for adding humidity to the air. A second embodiment utilizes a baffle in a supply manifold to the steam tubes which prevents air from being trapped in the steam tubes during system start-up and induces a more even rate of steam flow through the tubes.

3 Claims, 6 Drawing Sheets

COATED HEAT EXCHANGER FOR HUMIDIFIER

CROSS-REFERENCE TO COPENDING APPLICATION

This application is a continuation-in-part of patent application Ser. No. 604,347, filed Oct. 25, 1990, now abandoned, which in turn is a continuation of patent application Ser. No. 195,275, filed May 18, 1988 now abandoned.

BACKGROUND OF THE INVENTION

1. Field of the Invention

The present invention pertains to humidifiers of the type which are designed to be incorporated within a heating, ventilation and air conditioning ("HVAC") system. More particularly, the invention relates to steam-type humidifiers which use a heat exchanger to transfer thermal energy from a first steam source to heat water into steam.

2. Description of the Prior Art

Steam to steam type humidifiers such as the Model STS TM brand humidifier manufactured by Dri-Steem Humidifier Company of Eden Prairie, Minn. utilize a heat exchanger to transfer thermal energy from a first steam source to heat water into steam. Such systems allow waste steam which would be unfit for humidification uses to be used to produce a cleaner steam that is free from salts and other impurities which are likely to be found within conventional boiler generated steam.

The heat exchangers in such systems typically have several parallel branches, in order to maximize heat transfer between the steam and the water which is intended to be heated. The parallel heat exchanger branches are usually connected to common supply and return manifolds, which in turn are connected to a supply line having an automatic steam valve, and a return line having a steam trap, respectively.

Efficiency in such a system is maximized when the steam flows in an evenly distributed manner into the parallel heat exchanger branches. Unfortunately, this has proved somewhat difficult to achieve in practice, primarily because air tends to get trapped in one or more of the parallel branches when steam is introduced to the heat exchanger after a shut-down period during which the heat exchanger fills with air.

The present inventor believes that the problem is caused by unequal flow of the steam in the various branches, as it initially fills the heat exchanger after shut down.

When the steam valve in such a system first opens, the heat exchanger tubes are filled with air and the thermostatically controlled air valve inside the steam trap is cool and thus open to the return line. As pressure builds in the heat exchanger, the air is supposed to be pushed by the steam pressure through the air valve of the steam trap into the return line. When the steam reaches the steam trap the temperature causes the thermostatic air valve to close and the float operated valve in the steam trap then takes over, opening and closing as needed to drain away the condensate resulting from the condensing steam in the heat exchanger. If all of the air is not driven out of all the branches of the heat exchanger during this purging period it remains trapped. Trapped air in a branch prevents steam from effectively filling that branch and renders the branch incapable of heat transfer.

Accordingly, there has been a long and unfilled need in the prior art for a steam-type humidifier of the type which uses a heat exchanger to transfer thermal energy from a first steam source to heat water into steam which requires less frequent maintenance, and which is constructed to circulate the motive steam through the heat exchangers as evenly and as efficiently as possible.

SUMMARY OF THE INVENTION

Accordingly, it is an object of the invention to provide a humidifier of the type which uses a heat exchanger to transfer thermal energy from a steam source to heat water into steam which requires less frequent maintenance than those humidifiers heretofore known.

It is a second object of the invention to provide a humidifier of the type which utilizes a heat exchanger to transfer heat from a steam source to heat water into steam which is constructed to circulate the steam within the heat exchanger more efficiently than systems heretofore known.

It is a third object of the invention to provide a heat exchanger for a steam-to-steam humidification system which is designed to prevent air from becoming trapped in the heat exchanger branches thereof.

In order to achieve those and other objects of the invention, a steam-type humidifier for heating, ventilating and air conditioning systems according to a first aspect of the invention includes an evaporation chamber which is adapted to be filled with water; a heat exchanger within the evaporation chamber, the heat exchanger comprising a plurality of tubes, a supply manifold, the supply manifold being adapted to communicate with a source of hot steam, the supply manifold further being in communication with the tubes of the heat exchanger so that steam introduced into the manifold from the source will flow into the tube, and structure within the supply manifold for deflecting the steam as the steam enters the supply manifold, whereby the steam will be more likely to flow at even rates through the tubes.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof and to the accompanying descriptive matter, in which there is illustrated and described a preferred embodiment of the invention.

BRIEF DESCRIPTION OF THE DRAWINGS

Other objects of the present invention and many of the attendant advantages thereof will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
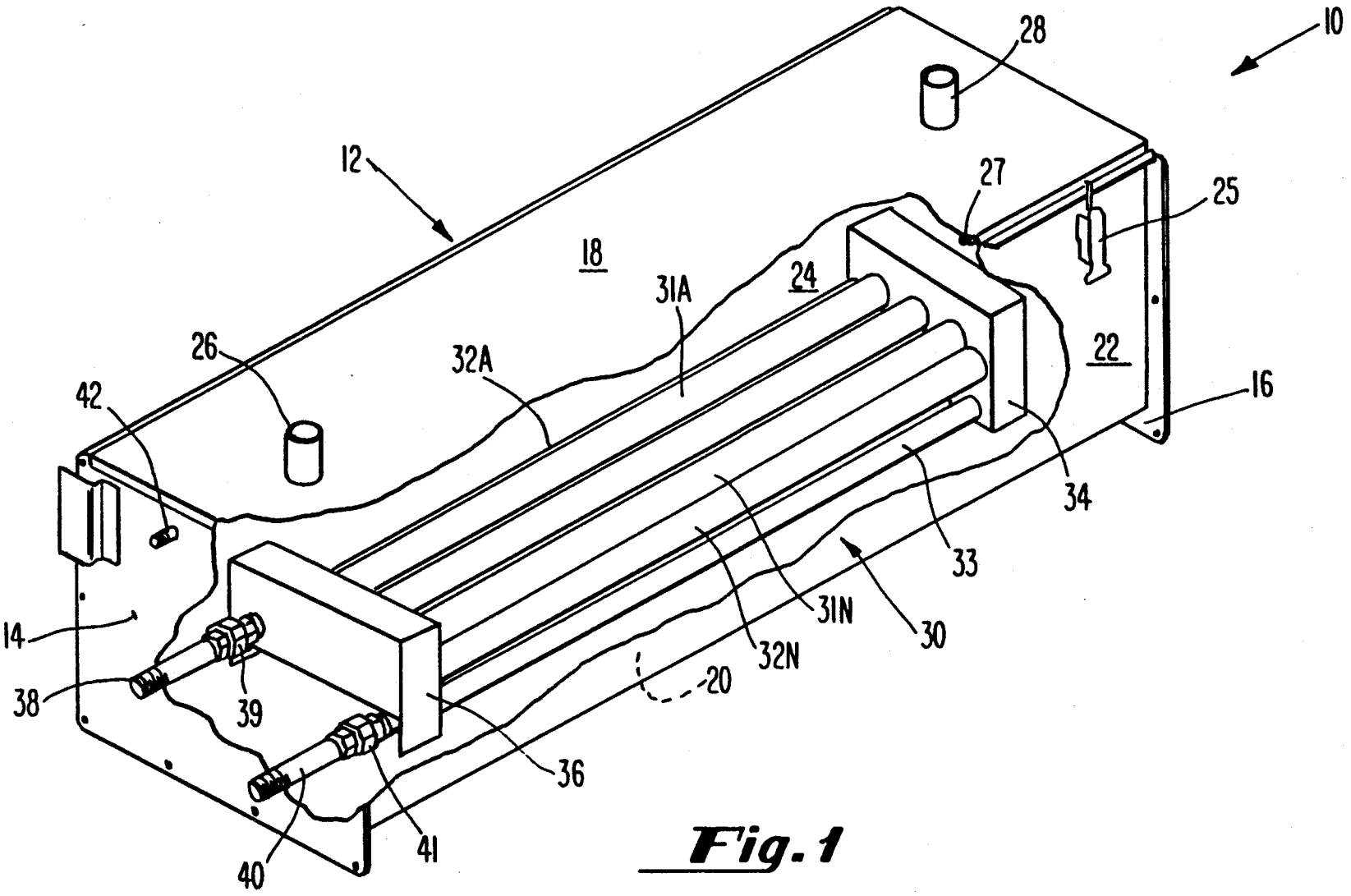
FIG. 1 illustrates a partial perspective view in cutaway of a humidifier interior.

FIG. 1 illustrates a perspective view in cutaway of a humidifier 10 including an evaporating chamber 12 which has a front face plate 14 and a back face plate 16, a removable top cover 18, a bottom 20, and sides 22, 24. A plurality of latches 25A-25N, of which 25A is illustrated, are mounted on a side 22 to secure the removable top cover 18 to the upper portion of the sides 22, 24, front face plate 14, and back face plate 16. A gasket 27 seals the removable top cover 18 and the sides 22, 24, the front face plate 14, and back face plate 16. Dispersion tube connections 26, 28 are secure to the removable top cover 18.

Figure 2:
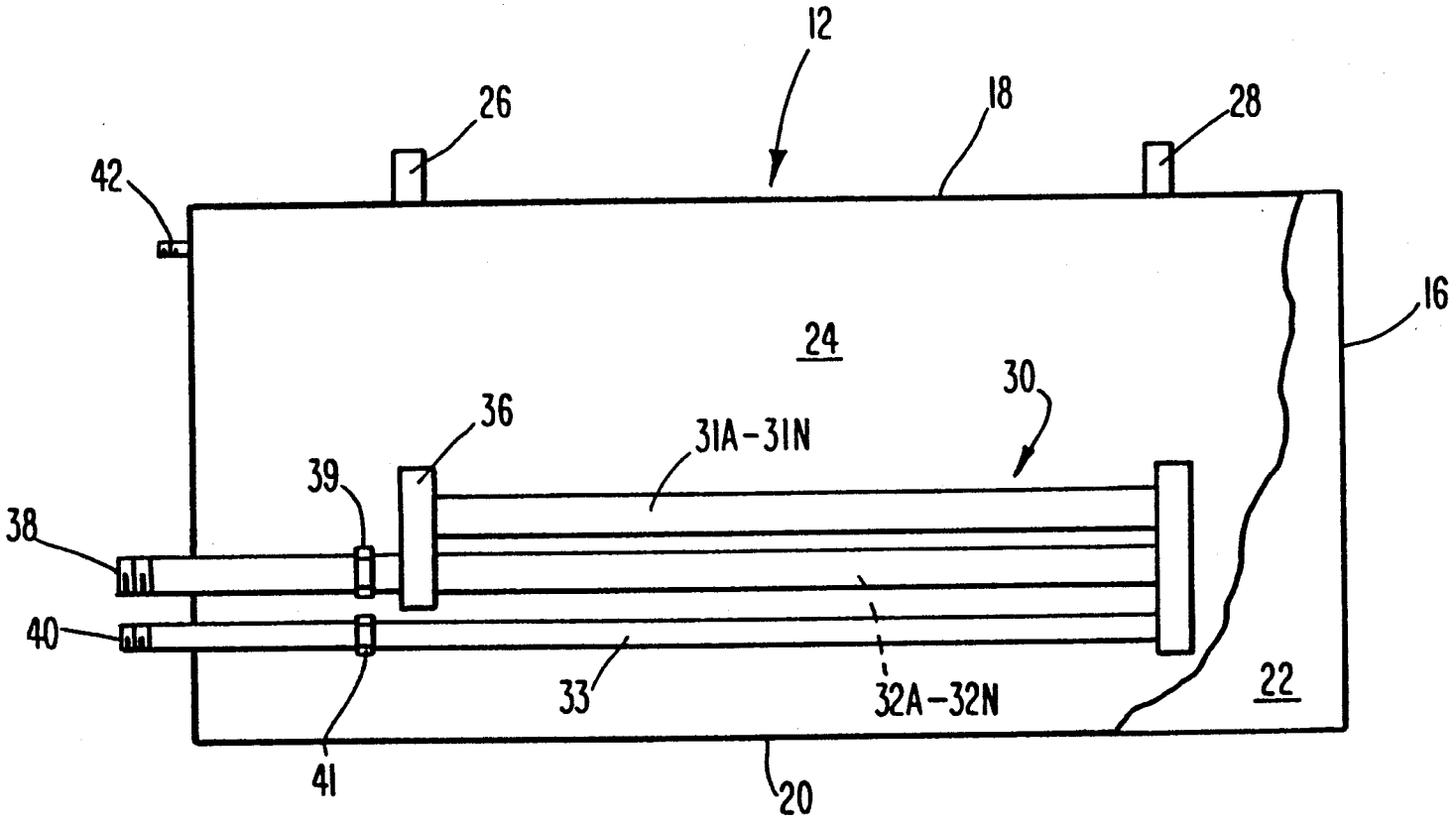
FIG. 2 illustrates an elevational view in cutaway of the heat exchanger array in the heat exchanger humidifier.

A heat exchanger array 30, also illustrated in FIG. 2, includes a plurality of steam or fluid tubes 31A-31N coated with non-stick surfaces, such as tetrafluoroethylene (TEFLON®) or the like, in an array. A plurality of steam or fluid tubes 32A-32N are also coated with a non-stick material and are placed beneath 31A-31N. The arrays are secured between a TEFLON® coated front tube manifold 36. The upper and lower TEFLON® coated tubes 31A-31N and 32A-32N are layered in substantially parallel horizontal planes. The individual steam tubes 31A-31N can be staggered vertically with respect to the tubes 32A-32N as further illustrated in FIGS. 2 and 3. (The "N" denotes a selected number of tubes.)

An inlet tube 38 is secured to the TEFLON® coated front steam manifold 36 through the front face plate 14 and a union 39. A drain tube 33 is secured to the TEFLON® coated rear manifold 34, and connects to an outlet tube 40 through a union 41. The tubes 31A-31N and 32A-32N, and the rear and front manifolds 34 and 36 are TEFLON® coated to prevent mineral scale build-up. Any suitable non-stick material can be utilized.

Humidification water is introduced into the humidifier evaporating chamber 12 through a water inlet nipple 42 located in front face plate 14. Steam or hot fluid, such as water or a synthetic material such as Dow-Therm, is circulated to provide the heat energy for evaporation. Pressurized hot water can likewise be utilized.

FIG. 2 illustrates an elevational view in cutaway of the plurality of heat exchanger tubes 30 in one interior chamber of the heat exchanger humidifier 10. Fluid is introduced into the inlet tube 38 and exits from the outlet tube 40 of the heat exchanger array 30 to heat water in the evaporation chamber 12 to create water vapor to be drawn from the evaporating chamber 12 at the dispersion tube connections 26 and 28. The use of layered heat exchanger tubes in the heat exchanger array 30 promulgates rapid thermal convection and turbulence of the water for increased heat transfer from the heat exchanger arrays to the water in the evaporation chamber 12.

Water first passes from the bottom region of the evaporation chamber 12, upwardly, through and around the lower TEFLON® coated tubes 32A-32N and the manifolds 34 and 36 of the heat exchanger array 30. Water then travels past the lower TEFLON® coated tubes 32A-32N upwardly through the members of the upper TEFLON® coated tubes 31A-31N of the heat exchanger array 30. The convected water circulates with greater fluid transfer which accelerates heating. Additional heat exchanger tube layers can be added as desired. Although two layers of TEFLON® coated tubes in the heat exchanger array 30 are illustrated, any number of tube layer arrays can be placed side by side, staggered or aligned in any regular or irregular geometric fashion to promote heat exchange through thermodynamics between the plurality of heat exchanger arrays and evaporative water by increasing evaporative water flow from all regions of the evaporation box.

Figure 3:
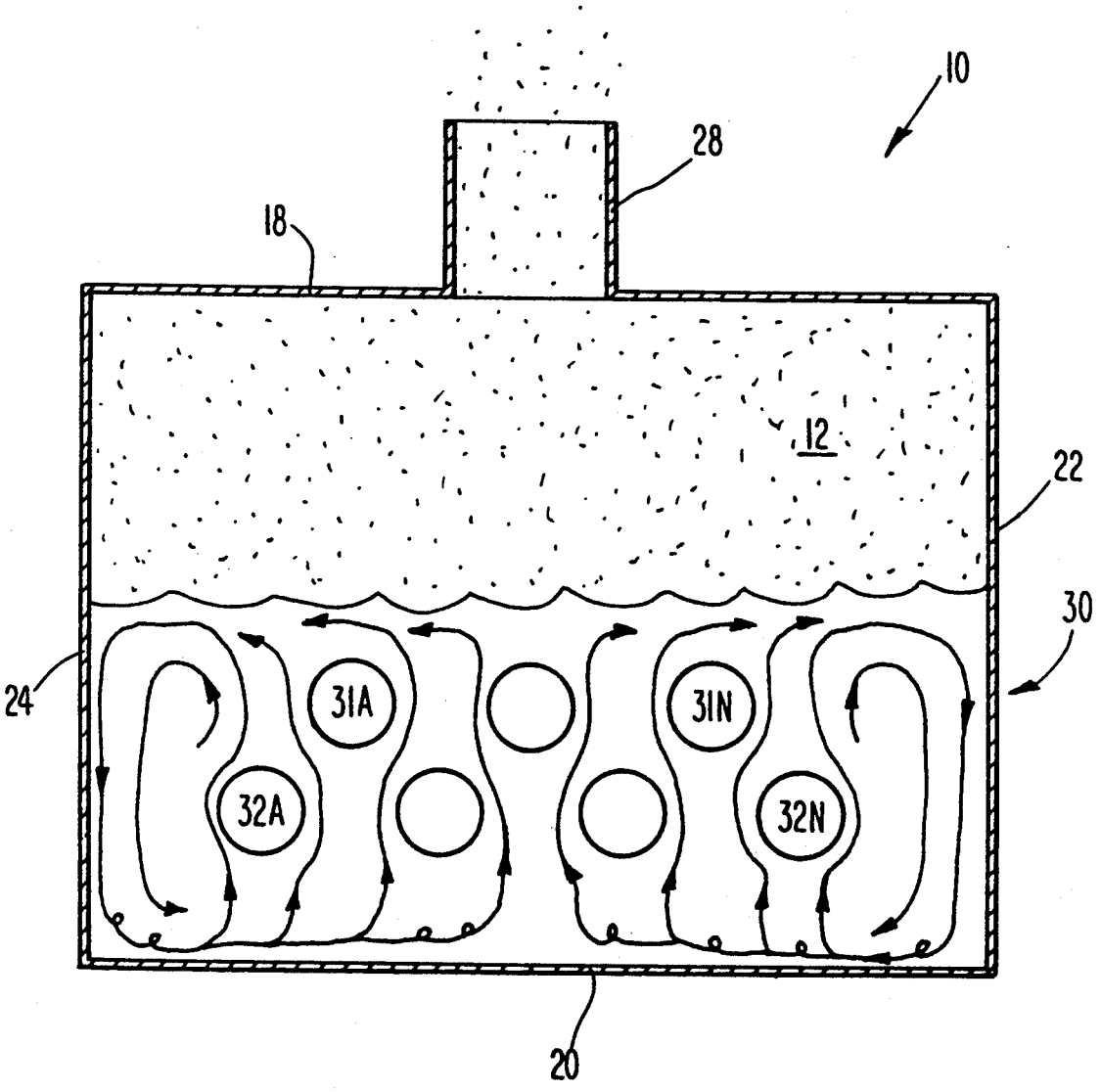
FIG. 3 illustrates an elevational view in cross-section of water flow in the humidifier.

FIG. 3 illustrates an elevational view in cross-section of the humidifier and the flow of water in the humidifier 10. Water from the lower region of the evaporative chamber 12 first passes upwardly past and through the lower TEFLON® coated tubes 32A-32N of the heat exchanger array 30 to absorb heat to be further heated and convected upwardly, through and around the elements of the substantially aligned upper TEFLON® coated steam tubes 31A-31N of the heat exchanger array 30 to cause further heat transfer and acceleration of the evaporative water. The flow proceeds from the upper regions of the evaporating chamber 12 where humidifying vapor as steam is released from the upper heated water surface, down the sides 22 and 24 of the evaporating chamber 12 and against the bottom 20 causing turbulence with cooler water particles, which consequently increases the heat exchanger efficiency and boil-off capacity.

Figure 4:
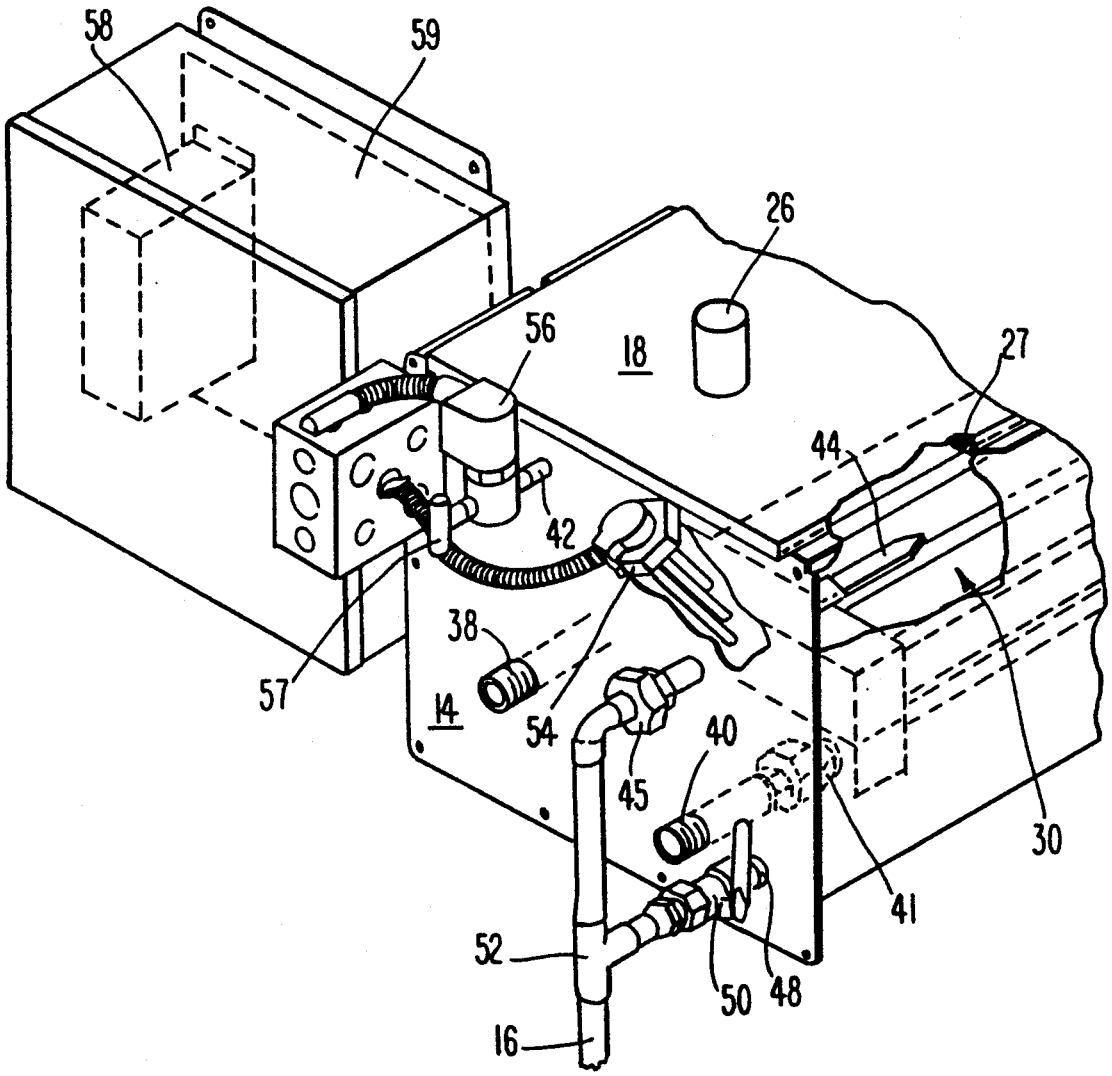
FIG. 4 illustrates a perspective view of the control components of the humidifier.

FIG. 4 illustrates a perspective view of the control components for the humidifier. An adjustable surface skimmer 44, or the like, as shown in the prior art, can be provided and connected by a union 45 with appropriate piping to a drain tube 46. A lower drain 48 and drain valve 50 also connect to the drain tube 46 with a "T" connector 52 for humidifier evaporating chamber drainage.

A conductivity probe 54 mounts in the front face plate 14 and connects to an electric solenoid valve 56 through a control module 58 in a cabinet 59 which maintains the water level at a predetermined level as sensed by the conductivity probe 54. The electric solenoid valve 56 allows water to flow into the humidifier evaporating chamber 12 from a water inlet tube 57 and through the water inlet nipple 42. In the alternative, a float operated water fill valve can be provided in lieu of the conductivity probe 54, the electric solenoid valve 56 and the control module 58.

Figure 5:
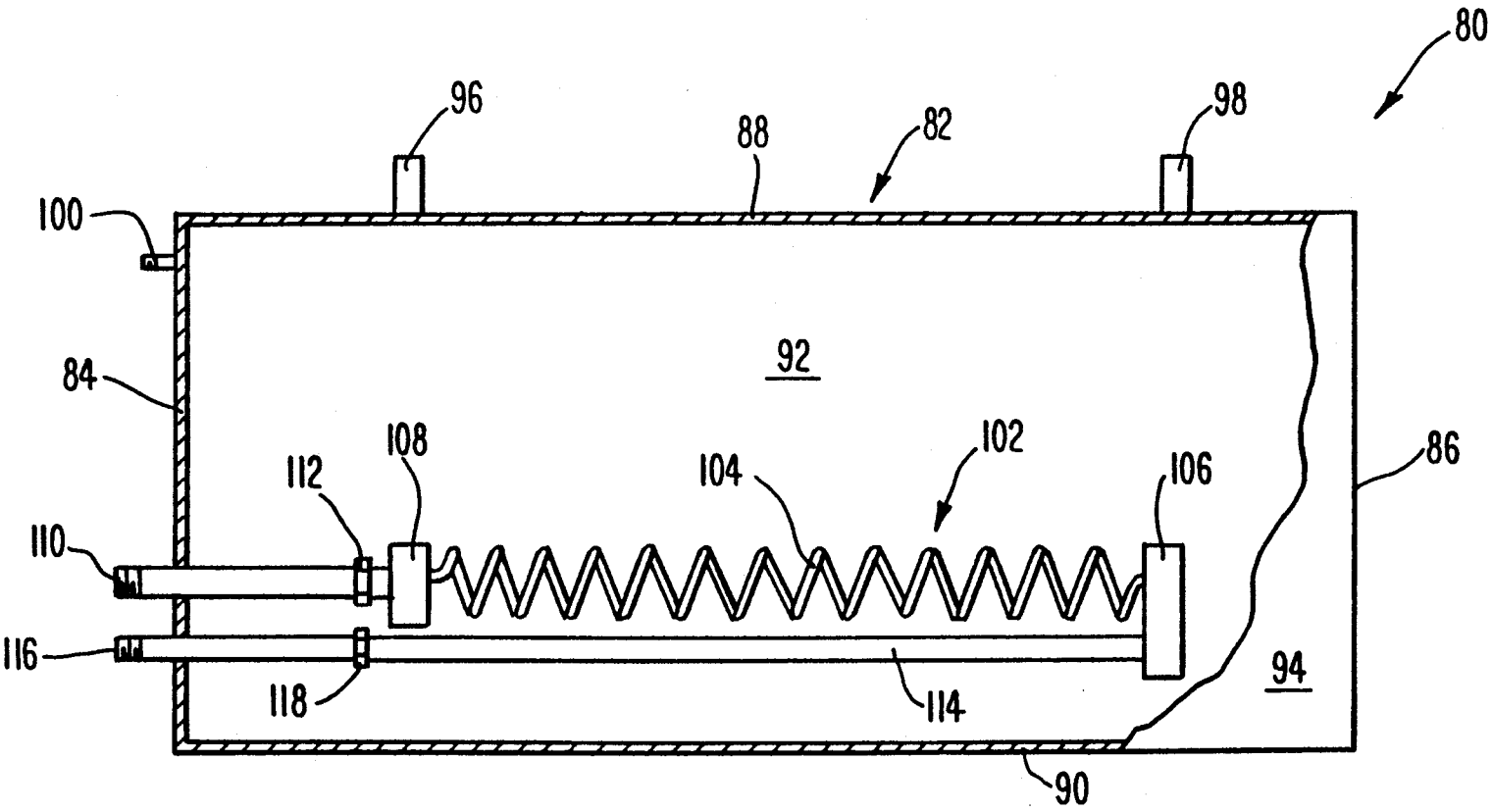
FIG. 5 illustrates an elevational view in cutaway of a heat exchanger array with a helical coil array.

FIG. 5 illustrates an elevational view of an alternative embodiment in cutaway of a fluid to vapor humidifier 80 including humidifier evaporating chamber 82 similar in construction to the evaporating chamber 12 of FIG. 1, including face plates 84 and 86, a removable top cover 88, a bottom 90 and sides 92 and 94. Dispersion tube connections 96 and 98 are secured to the removable top cover 88. A water inlet nipple 100 located on the face plate 84 allows for introduction of humidifier water into the evaporating chamber 82. Latches and gaskets similar to those of FIG. 1 are also incorporated, but not illustrated for purposes of brevity and clarity in the illustrations.

One or more heat exchanger helical arrays 102 are located in the evaporating chamber 82, and each includes a helical TEFLON® coated tube 104 secured between a TEFLON® coated front water manifold 108. A fluid inlet tube 110 secures to the front TEFLON® coated manifold through a union 112, and water drain tube 114 secures to the TEFLON® coated rear water manifold 106 and connects to a water outlet tube 116 through a union 118. The helical TEFLON® coated tube 104 and the front and rear steam manifolds 108 and 106 are TEFLON® coated to prevent mineral scale buildup or aid in scale shedding.

One or more similar arrays can be substantially vertically aligned with respect to each other in the evaporating chamber 82 to provide for levels of heating, or can be placed side by side and manifolded together externally or be provided with fluid from one or more sources to any number of heat exchanger arrays 102 in the evaporating chamber 82. Skimmers, drain tubes, conductivity probes, solenoid valves, control modules and the like, as described in FIG. 4, are also used to provide level control, drainage and cleaning of the hot water to vapor humidifier 80.

Steam or hot fluid is passed through the TEFLON® coated heat exchange array 30 to boil water contained in the humidifier evaporating chamber 12 to produce steam which passes from the humidifier evaporating chamber 12 through dispersion tube connections 26 and 28. Any mineral scale which develops on the TEFLON® coated steam tubes 31A–31N and 32A–32N or rear and front manifolds 34 and 36 is continuously shed due to the action of the boiling water in the humidifier evaporating chamber 12, as well as the cycling of the steam through the TEFLON® coated steam tubes 31A–31N and 32A–32N and rear and front manifolds 34 and 36. Any shed mineral scale settles to the bottom of the humidifier evaporating chamber 12 and is periodically manually removed; or in the alternative, floats to the water surface and is removed through the adjustable surface skimmer 44 through the natural skimming flow of the water.

As described in FIG. 3, evaporative water passes by and through the lower TEFLON® coated steam tube arrays 32A–32N of the heat exchanger array 30, is accelerated, and heated. The water is further heated and accelerated as it passes by the upper TEFLON® coated steam tubes 31A–31N in heating and accelerating, causing a greater heat exchange and convection flow, enhancing turbulence flow and thus increased mixing of water particles in different portions of the chamber.

Various modifications can be made to the present invention without departing from the apparent scope hereof. The heat exchanger assembly can be a hot water heat exchanger with the tubes configured accordingly for passage of steam, hot water or hot fluid. The tube or tubes can also be in a serpentine configuration with the upper steam tubes of an array aligned or displaced substantially above the lower steam tubes in the array. Any suitable non-stick material can be utilized such as tetrafluoroethylene (TEFLON®) or its derivatives.

The overflow surface skimmer 44 is an overflow channel or trough that drains water when the water exceeds a certain level. As such overflow water drains off, it carries floating mineral "scum" with it.

Figure 6:
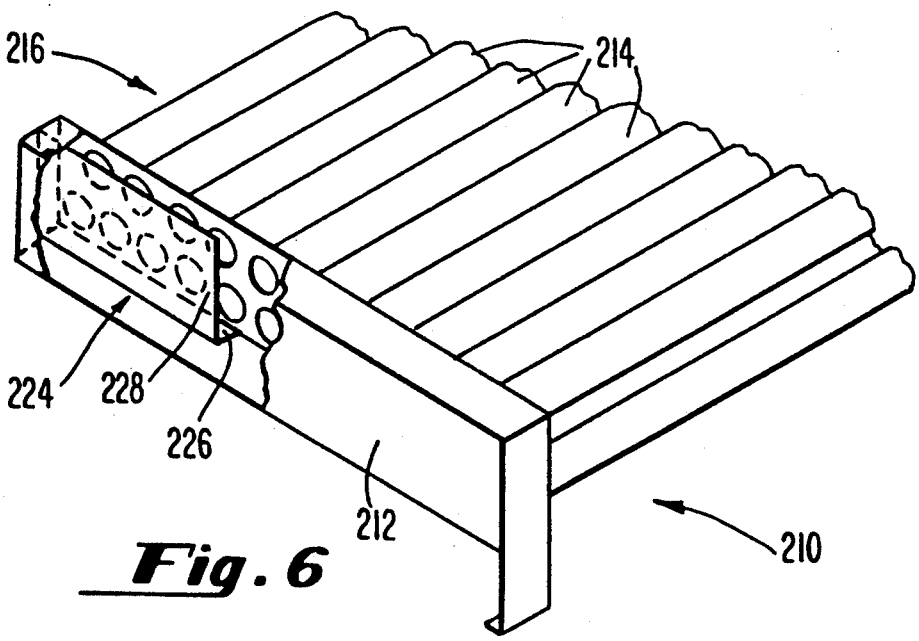
FIG. 6 is a fragmentary perspective view depicting a second embodiment of a humidifier according to the present invention.
Figure 7:
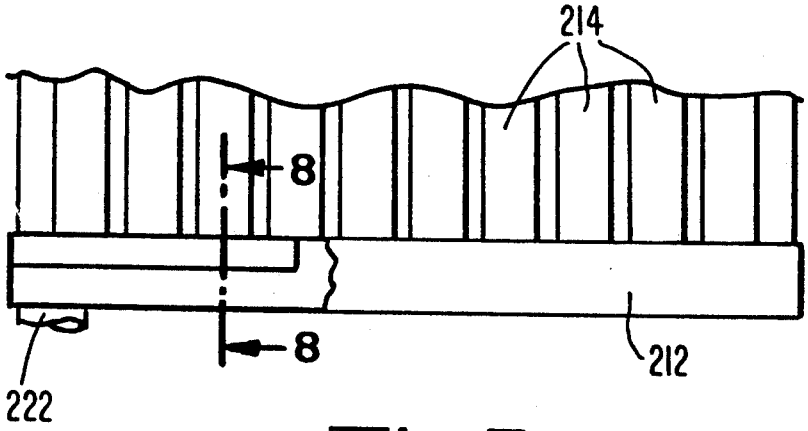
FIG. 7 is a top plan fragmentary view depicting the embodiment illustrated in FIG. 6.
Figure 8:
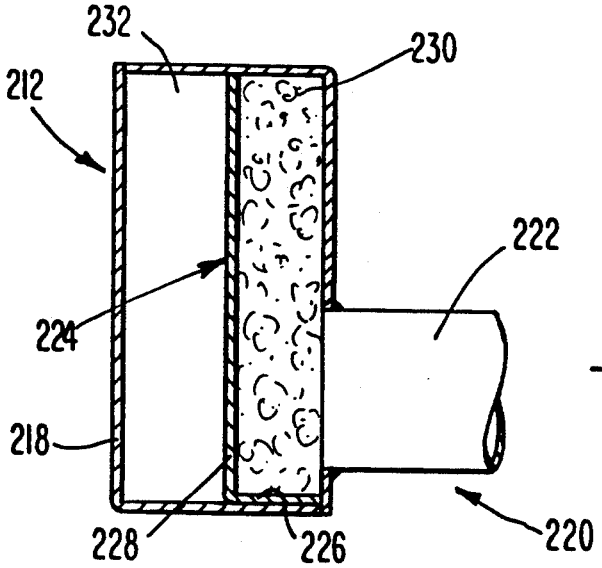
FIG. 8 is a cross-sectional view taken along lines 8—8 in FIG. 7.

Referring now to FIGS. 6–8, a second embodiment 210 of a humidifier assembly according to the invention includes a modified supply manifold 212 which is in communication with a heat exchanger 216 having a plurality of heat exchanger tubes 214. In the preferred embodiment, supply manifold 212 is constructed as a rigid box-shaped member 218 having a rectangular cross-section, as may best be seen in FIG. 8. As can further be seen in FIG. 8, supply manifold 212 is adapted for communication with a source 220 of steam, as in the previously described embodiment. In FIGS. 6–8, the source 220 of steam is embodied as an inlet pipe 222.

According to one novel aspect of the invention, a baffle 224 having a foot section 226 and a leg section 228 is positioned within the supply manifold 212. More specifically, the foot section 226 of baffle 224 is affixed by welding or by other means to an interior surface of the box-shaped member 218. Leg section 228 is adapted to extend from the interior surface to which foot section 226 is attached to a second interior surface of box-shaped member 218 which is opposite the surface to which foot section 226 is attached. As may be seen in FIGS. 6–8, baffle 224 is positioned between the inlet pipe 222 and the tubes 214 which are closest to the inlet pipe 222. As a result, baffle 224 is positioned to deflect the steam entering supply manifold 212 via inlet pipe 222. This has the effect of breaking the momentum of the steam as it enters the supply manifold 212. In the past, it has been found that the tubes closest to and/or in alignment with the inlet pipe 222 typically carried a higher flow rate of steam than those tubes which were distant from the inlet pipe. In addition, air tended to become trapped in some of the tubes 214 during system start-up. By breaking the momentum of the steam within baffle 224, the steam in the supply manifold 212 is caused to present an even, well distributed entrance pressure to the heat exchanger tubes 214. During start-up, this ensures that steam will flow into each of the tubes 214 at approximately the same rate, and with approximately the same impetus. As a result, air will not become trapped in any of the branches. During steady-state operation of the system, the effect in the supply manifold 212 that is created by the baffle 224 will also cause the steam or fluid to flow through the tubes 214 at a more uniform flow rate than was previously possible. Consequently, the efficiency of heat exchanger 216 is increased.

In operation, when steam is introduced from inlet pipe 222 into supply manifold 212, the steam enters a first space 230 which is defined by a forward surface of baffle 224 and the interior surface of the wall of box-shaped member 218 through which inlet pipe 222 extends. The steam is carried into baffle 224, and its forward momentum is broken into a swirling type pattern, as is shown schematically in FIG. 8. The steam then flows gently around the baffle 224 toward the rear side wall of supply manifold 212 where it enters the various tube members 214 of heat exchanger 216.

Although the present invention has been described with reference to preferred embodiments, workers skilled in the art will recognize that changes may be made in form and detail without departing from the spirit and scope of the invention.

What is claimed is:

1. A steam type humidifier for a heating, ventilating and air conditioning system comprising:

a rectangular box-shaped housing defining an evaporation chamber adapted to be filled with water and having a removable top cover with dispersion tube connections secured thereto to distribute steam to said heating, ventilating and air conditioning system;

a heat exchanger located within said evaporation chamber, said heat exchanger comprising upper and lower layers of parallel tubes longitudinally spaced substantially evenly in parallel horizontal planes, said tubes in each of said layers being in staggered relationship to the tubes of the other of said layers;

a supply manifold positioned at one end of said housing communicating with a steam source and connected in parallel to one end of all of said tubes so that steam introduced into said manifold from said source will flow into said tubes;

an outlet manifold positioned at an opposite end of said housing connected to the opposite end of said tubes for receiving said steam passing from said tubes and a drain tube for discharging steam secured to said outlet manifold and passing below said lower layer of tubes to said one end of said housing;

said supply manifold being box-shaped with a rectangular cross-section and having an inlet connection for said steam source arranged parallel to the axis of said tubes at one end of said supply manifold; and a baffle having a foot section extending from a wall of the supply manifold to which said tubes are connected and fixed along the bottom of said supply manifold and an unperforated leg section extending upwardly and attached to the top of said supply manifold and positioned relative to said inlet pipe to form means to deflect all of said steam substantially perpendicularly relative to the axis of said supply manifold inlet connection and in one direction along said supply manifold before entering said tubes, thereby breaking the momentum of said steam as it enters the supply manifold and evenly distributing said steam to prevent air from becoming trapped.

2. A humidifier according to claim 1, wherein said tubes are covered with a non-stick surface.

3. A humidifier according to claim 2, wherein said non-stick surface comprises polytetrafluoroethylene.

* * * * *